US012262854B1

(12) United States Patent
Chen

(10) Patent No.: US 12,262,854 B1
(45) Date of Patent: Apr. 1, 2025

(54) PORTABLE TOILET

(71) Applicant: Taizhou Xiaotanglang Infant and Child Products Co., Ltd., Taizhou (CN)

(72) Inventor: Jian Chen, Taizhou (CN)

( * ) Notice: Subject to any disclaimer, the term of this patent is extended or adjusted under 35 U.S.C. 154(b) by 0 days.

(21) Appl. No.: 18/828,090

(22) Filed: Sep. 9, 2024

(30) Foreign Application Priority Data

Sep. 28, 2023 (CN) ..... 202322659629.4

(51) Int. Cl.
*A47K 11/04* (2006.01)

(52) U.S. Cl.
CPC ..... *A47K 11/04* (2013.01)

(58) Field of Classification Search
CPC ..... A47K 11/04; A47K 13/06
See application file for complete search history.

(56) References Cited

U.S. PATENT DOCUMENTS 6,341,386 B1 * 1/2002 Phillips ..... A47K 11/06 4/479
7,770,242 B2 * 8/2010 Sell ..... A47K 11/06 4/483
9,414,723 B2 * 8/2016 Capraro ..... E05D 11/1028
2009/0320194 A1 * 12/2009 Lovatt ..... A47K 13/06 4/237

* cited by examiner

*Primary Examiner* — Christine J Skubinna

(57) ABSTRACT

A portable toilet includes a toilet main body, connecting elements, elastic members and a plurality of supporting portions. Connecting elements rotatably arranged on the toilet main body. A plurality of supporting portions movably arranged on the connecting elements. Plug-in assemblies arranged between the supporting portions and the toilet main body. The plug-in assemblies include positioning slots and positioning block. The positioning blocks are placed in the positioning slots when the supporting portions are in a supporting state. Elastic members, wherein when a storage state is switched to a supporting state, the supporting portions rotate relative to the toilet main body and slide relative to the connecting elements. Positioning blocks can be separated from the positioning slots, so that the supporting portions can rotate conveniently.

20 Claims, 11 Drawing Sheets

PORTABLE TOILET

CROSS-REFERENCE TO RELATED APPLICATIONS

The application claims priority of Chinese patent application CN202322659629.4, filed on 2023 Sep. 28, which is incorporated herein by reference in its entireties.

TECHNICAL FIELD

The present disclosure relates to the technical field of toilets, and in particular, to a portable toilet.

BACKGROUND

A portable child toilet, designed for potty training for children, generally includes a potty and a plurality of brackets. The brackets can be rotatably arranged on the potty. When the potty is folded, the brackets can be folded up to achieve a storage effect and facilitate a user to carry and use the portable toilet when going out. However, according to the existing portable child toilet, when the brackets are opened to support the potty, a cooperation way between a convex block and a clamping slot is usually used, namely, a buckle is used to position the brackets when the brackets are rotated to a supporting position. However, the positioning stability during supporting of the brackets is poor because of the small volumes of the convex block and the clamping slot, resulting in poor supporting stability. Furthermore, with the increase of the service time, the convex block and the clamping slot are easily worn and broken, which affects the positioning during the rotation of the brackets and the service life of the brackets during rotary positioning.

SUMMARY

The present disclosure mainly aims to provide a portable toilet, to solve the problem that rotation of existing brackets of the existing portable child toilet for supporting and positioning is achieved using a buckle, which affects the service life of rotation and positioning of the brackets.

The technical solution adopted by the present disclosure to solve the technical problem is as follows.

A portable toilet, includes:

a toilet main body;

connecting elements rotatably arranged on the toilet main body;

a plurality of supporting portions movably arranged on the connecting elements;

plug-in assemblies arranged between the supporting portions and the toilet main body, wherein the plug-in assemblies include positioning slots and positioning blocks; the positioning blocks are placed in the positioning slots when the supporting portions are in a supporting state; and elastic members, wherein when a storage state is switched to a supporting state, the supporting portions rotate relative to the toilet main body and slide relative to the connecting elements; and the elastic members are configured to provide the supporting portions with a tendency to move from the outside toward the toilet main body.

Further, each connecting element includes a rotating shaft and a guide rod; the rotating shaft is arranged on the toilet main body; one end of the guide rod is connected to the rotating shaft; and each supporting portion is movably arranged on the guide rod.

Further, a movable slot is provided on the supporting portion; a first abutment boss is arranged at one end of the guide rod away from the rotating shaft, and a second abutment boss opposite to the first abutment boss is arranged in the movable slot; the guide rod is at least partially placed in the movable slot, and each elastic member is placed in the movable slot; and two ends of the elastic member respectively abut against the first abutment boss and the second abutment boss.

Further, the guide rod is provided with a ferrule at one end close to the rotating shaft, and the ferrule sleeves the rotating shaft.

Further, an accommodating slot configured to accommodate the rotating shaft is provided at one end of the supporting portion close to the rotating shaft.

Further, each positioning block includes an extending portion; the extending portion is close to one end of the rotating shaft by the supporting portion; the extending portion is located on one side of the accommodating slot;

each positioning slot includes a first limiting slot; the first limiting slot is arranged on the toilet main body; and the extending portion is placed in the first limiting slot when the supporting portion is in the supporting state.

Further, the toilet main body is provided with an avoidance slot communicated to the positioning slot, and the supporting portion is at least partially placed in the avoidance slot.

Further, the toilet main body is provided with shaft holes on two side walls of the avoidance slot, and two ends of the rotating shaft are respectively placed in the shaft holes on the two sides of the avoidance slot.

Further, the two side walls of the avoidance slot are formed with guide slopes; and the guide slopes are located below the shaft holes.

Further, each positioning block includes a limiting convex block; the limiting convex block is arranged on a side wall of the avoidance slot;

the positioning slot includes a second limiting slot provided on the supporting portion; and the limiting convex block is placed in the second limiting slot when the supporting portion is in the folded state or the supporting state.

Further, each second limiting slot includes a supporting state slot and a folded state slot which are provided on the supporting portion; the limiting convex block is placed in the supporting state slot when the supporting portion is in the supporting state, and the limiting convex block is placed in the folded state slot when the supporting portion is in the folded state; a side wall of the supporting portion extends along a height of the portable toilet when the supporting portion is in the supporting state; and the side wall of the supporting portion approaches a bottom surface of the portable toilet when the supporting portion is in the folded state.

Further, each second limiting slot further includes an unfolded state slot; the limiting convex block is placed in the unfolded state slot when the supporting portion is in an unfolded state; the side wall of the supporting portion extends in a lengthwise or width direction of the portable toilet when the supporting portion is in the unfolded state; and the supporting portion is located on an outer side of the toilet main body.

Further, two extending portions are located on two opposite sides of the accommodating slot; the supporting state slot and the folded state slot are respectively located on the two opposite sides of the accommodating slot; the folded state slot is communicated to the supporting state slot; and the supporting state slot, the folded state slot, and the unfolded state slot are all communicated to the accommodating slot.

Further, an antiskid sleeve is arranged at a bottom of each supporting portion.

Further, each supporting portion includes a first supporting member and a second supporting member connected to the first supporting member; and the movable slot and the second abutment boss are both located on the first supporting member.

Further, the second supporting member has a chamber with an opening in one side; a stiffener and a stud are arranged in the chamber;

the first supporting member is at least partially located in the chamber; and the first supporting member is locked on the stud through a screw.

Further, the toilet main body includes a supporting ring and a foldable potty; the supporting ring is arranged at a top of the potty; the connecting elements are rotatably connected to the supporting ring; and a material of at least a portion of the supporting ring is a hard material.

Further, the potty includes an annular wall and a potty bottom; the potty bottom is arranged at a bottom of the annular wall; the supporting ring is arranged at a top of the annular wall; a material of the annular wall is a flexible material;

a width and length of the annular wall gradually decrease from top to bottom; and at least one crease is arranged on the annular wall.

Further, the supporting ring includes a connecting ring and a decorative shell; the connecting ring is connected to the annular wall; and the decorative shell is arranged on the connecting ring.

Further, a top of the decorative shell is recessed downwards to form a toilet groove;

the decorative shell includes a top shell and a bottom shell; the connecting ring is located between the top shell and the bottom shell; the top shell is connected to the bottom shell and compresses the connecting ring; and the toilet groove is located on the top shell.

Beneficial effects: Compared with the prior art, by the arrangement of the connecting elements and the elastic members and the movable arrangement of the supporting portions on the connecting elements, when the supporting portions rotate, the supporting portions can move relative to the connecting elements, and positioning blocks can be separated from the positioning slots, so that the supporting portions can rotate conveniently. Furthermore, after the supporting portions rotate in place, the supporting portions are released. Under the action of the elastic members, the positioning blocks can be placed in the positioning slots to position the supporting portions and prevent the supporting portions from rotating freely. In this structure, the volumes of the positioning blocks can be configured to be larger to enhance the positioning effect on the supporting portions and effectively prolong the service life of the rotating and positioning structures of the supporting portions. The problem of poor positioning effect on the supporting portions due to small volumes of buckles used by the supporting portions in the existing portable toilet and the problem of low service life of the supporting portions for rotating and positioning because the supporting portions are easily worn are solved.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

DETAILED DESCRIPTION OF THE EMBODIMENTS

The accompanying drawings in the embodiment of the present disclosure are combined, The technical scheme in the embodiment of the present disclosure is clearly and completely described, Obviously, the described embodiment is only a part of the embodiment of the present disclosure, but not all embodiments are based on the embodiment of the present disclosure, and all other embodiments obtained by ordinary technicians in the field on the premise of not doing creative work belong to the protection range of the present disclosure.

Figure 1:
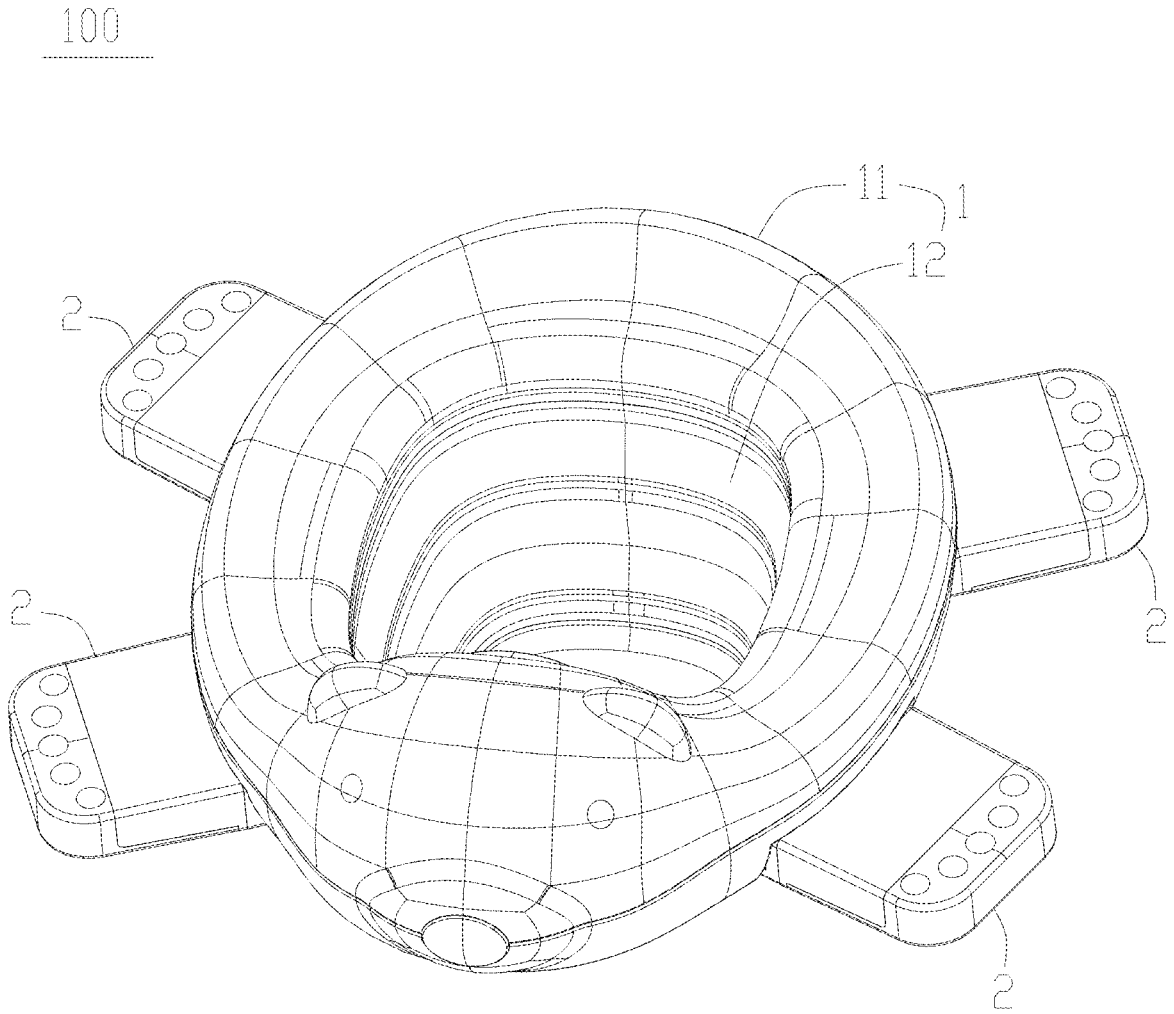
FIG. 1 is a schematic diagram of supporting portions in an unfolded state in a portable toilet in the present disclosure.
Figure 2:
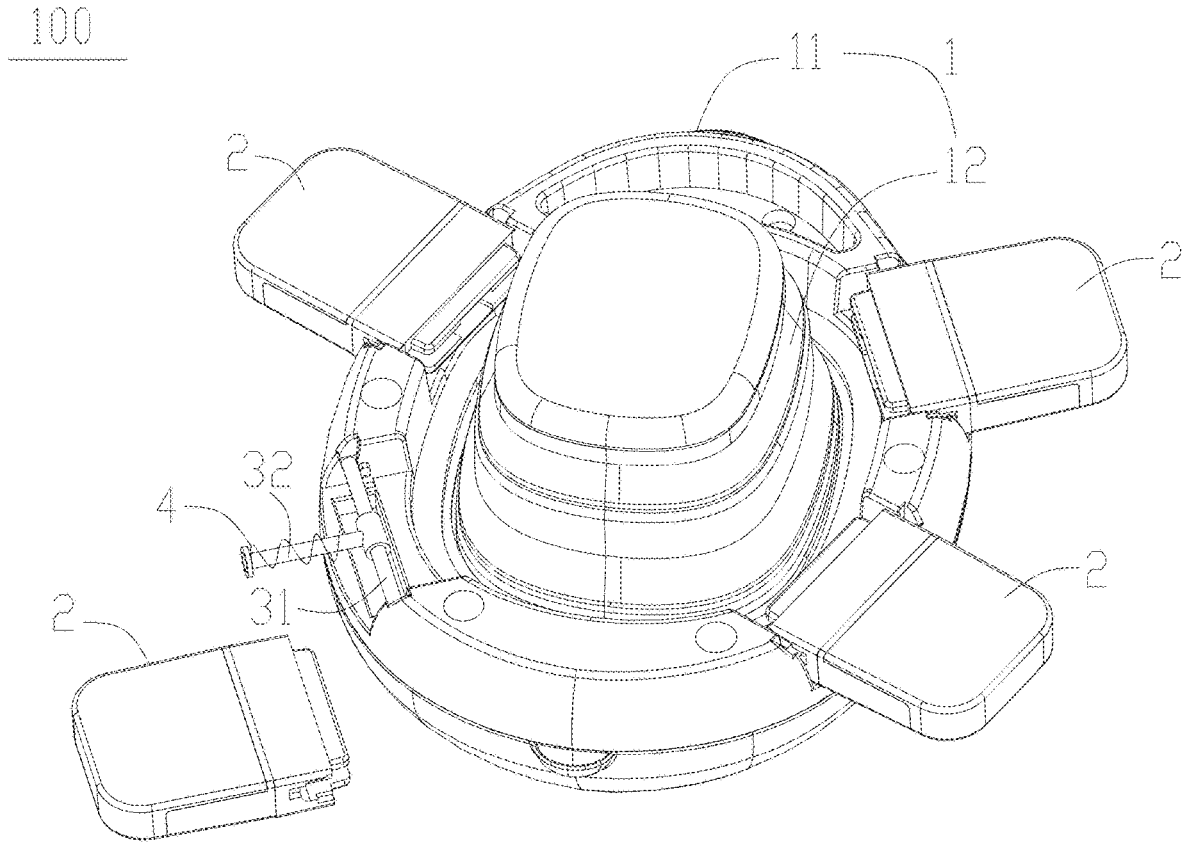
FIG. 2 is a partially exploded diagram of supporting portions in an unfolded state in a portable toilet in the present disclosure.
Figure 3:
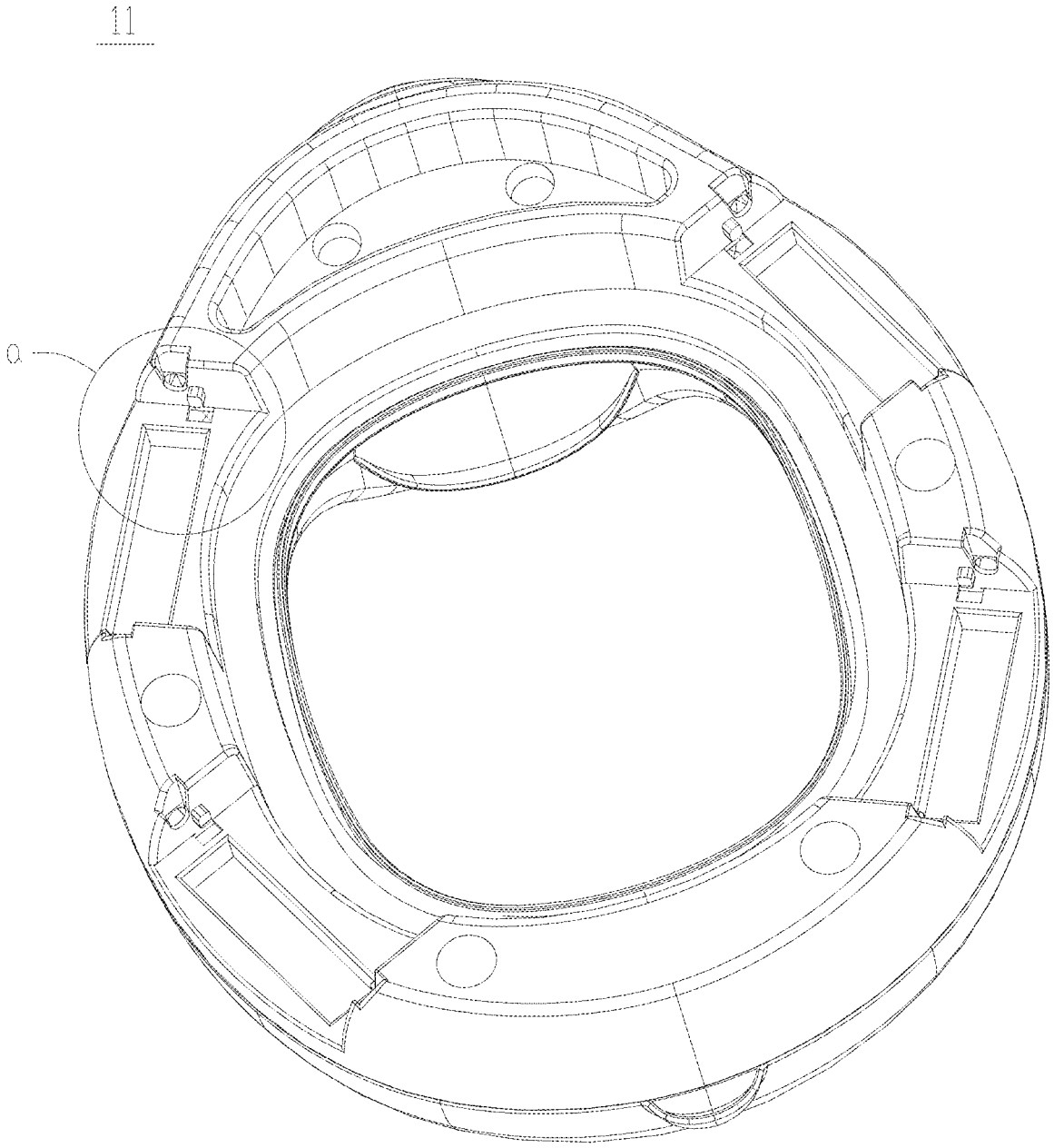
FIG. 3 is a structural diagram of a supporting ring of the present disclosure.
Figure 4:
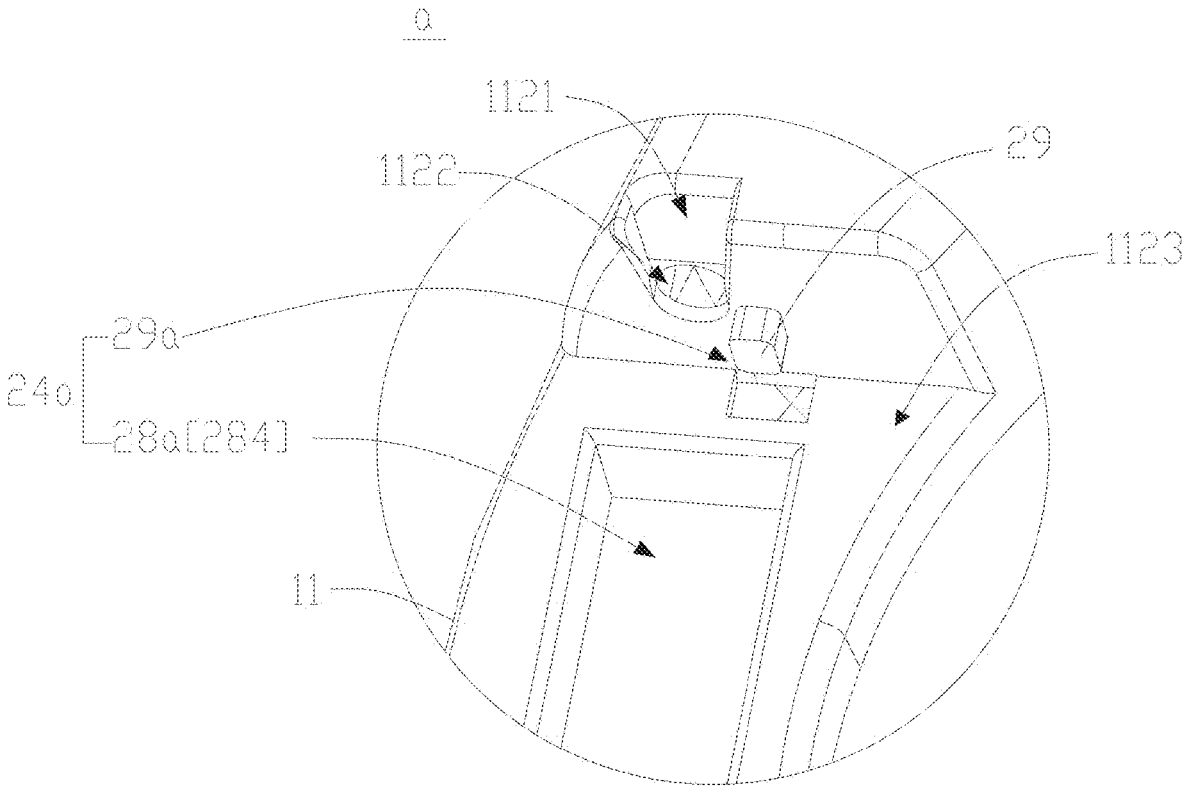
FIG. 4 is an enlarged view of region a in FIG. 3.
Figure 5:
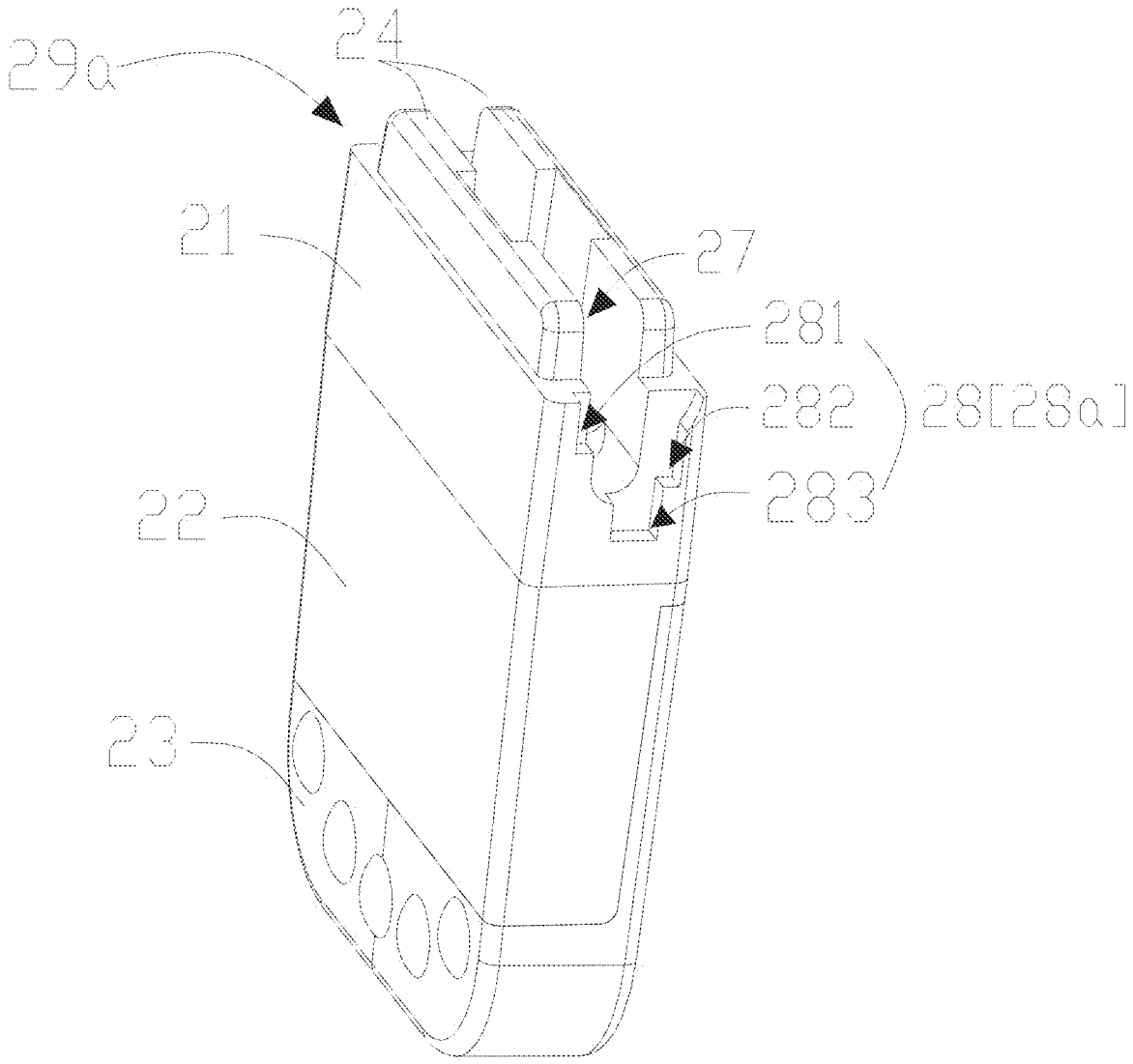
FIG. 5 is a structural diagram of a supporting portion of the present disclosure.
Figure 6:
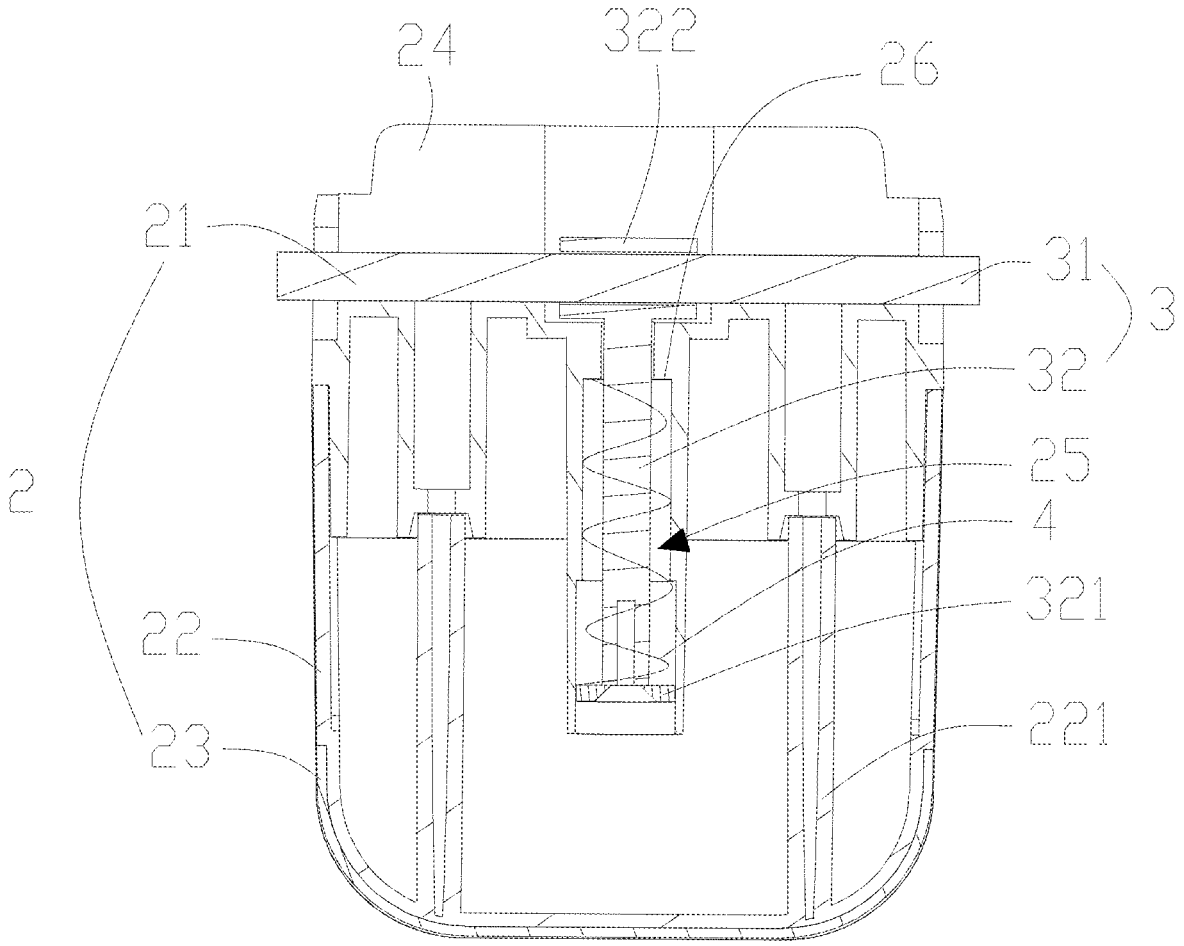
FIG. 6 is a sectional view of assembling a supporting portion, a connecting element, and an elastic member and sectioning them along an axis of the rotating shaft.
Figure 7:
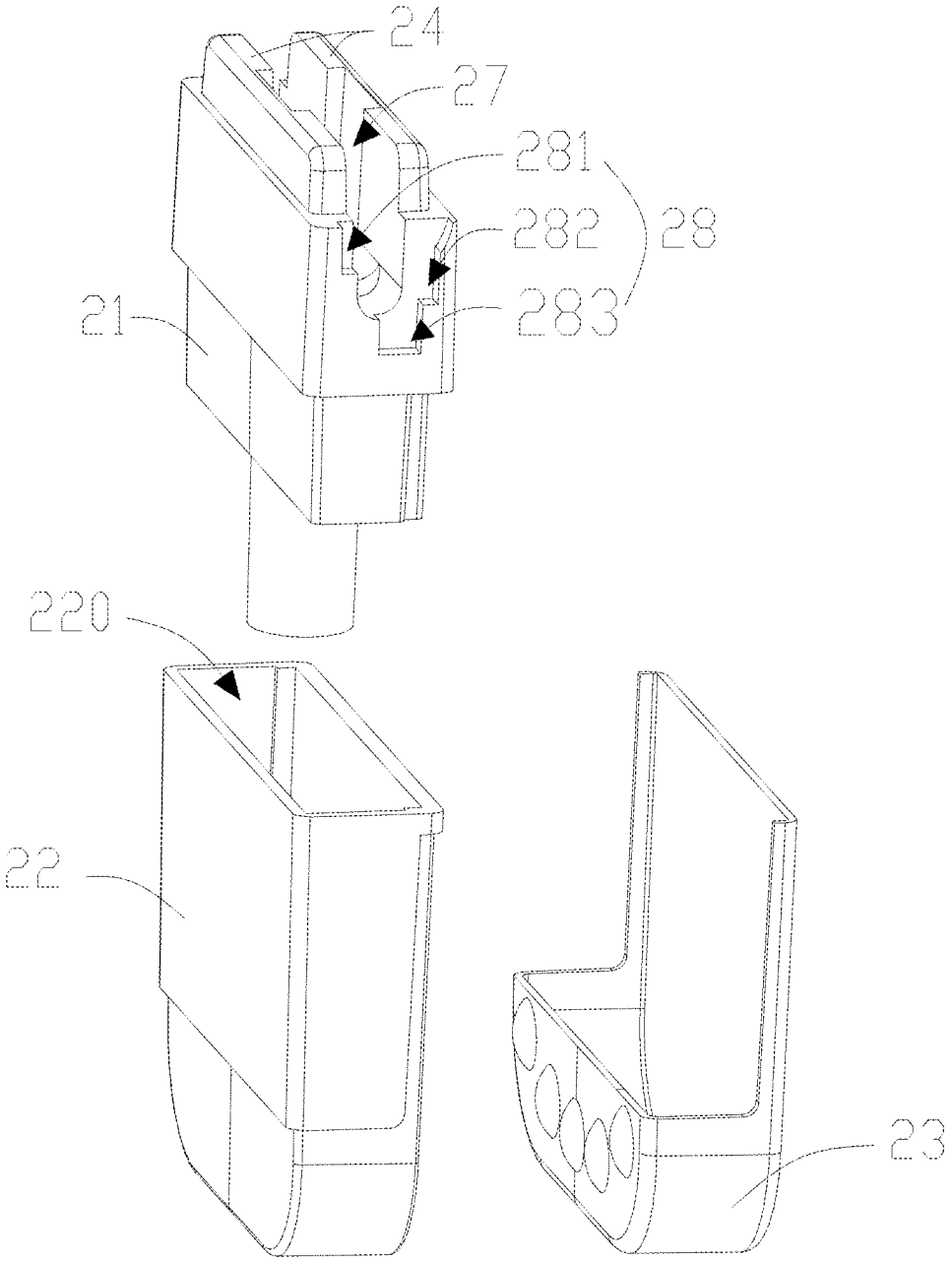
FIG. 7 is an exploded diagram of a supporting portion of the present disclosure.
Figure 8:
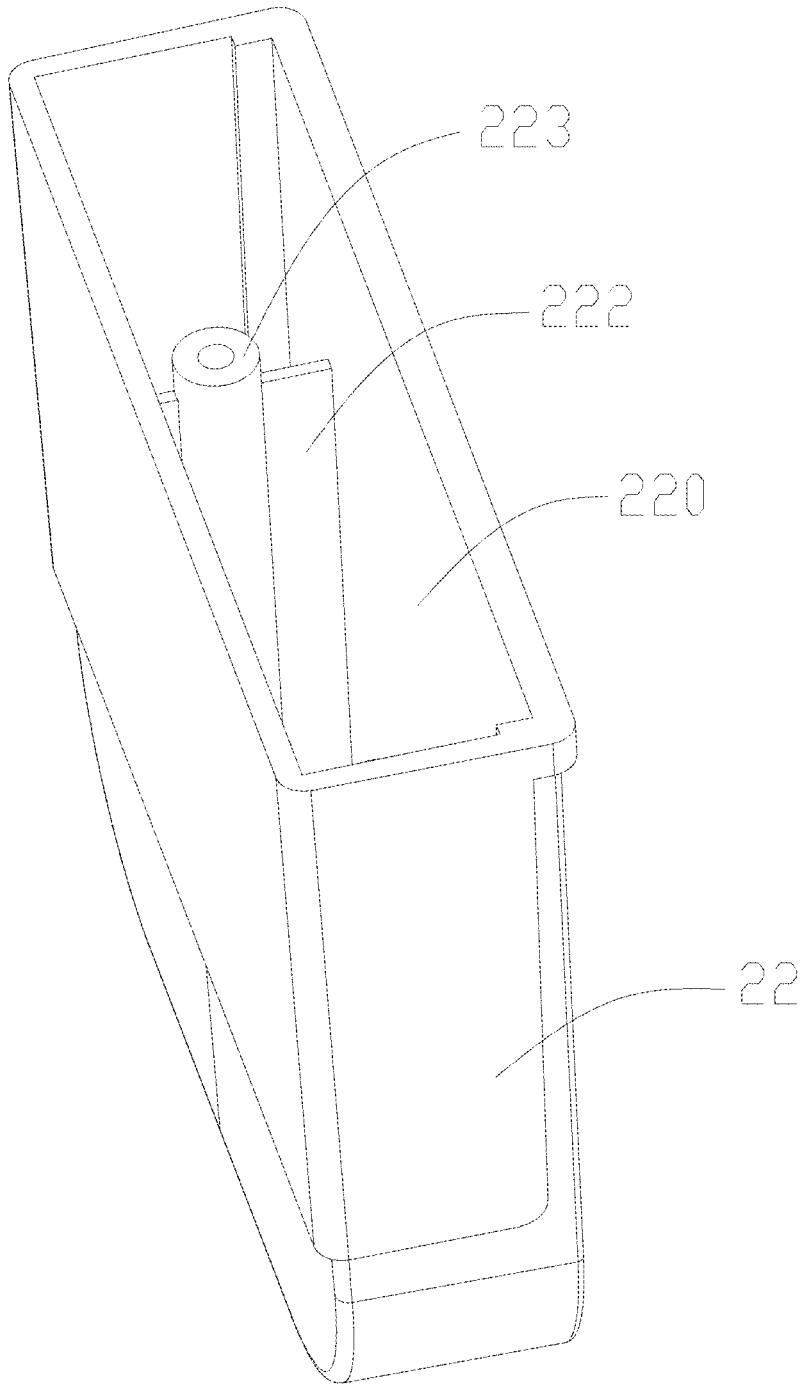
FIG. 8 is a structural diagram of a second supporting member of the present disclosure.
Figure 9:
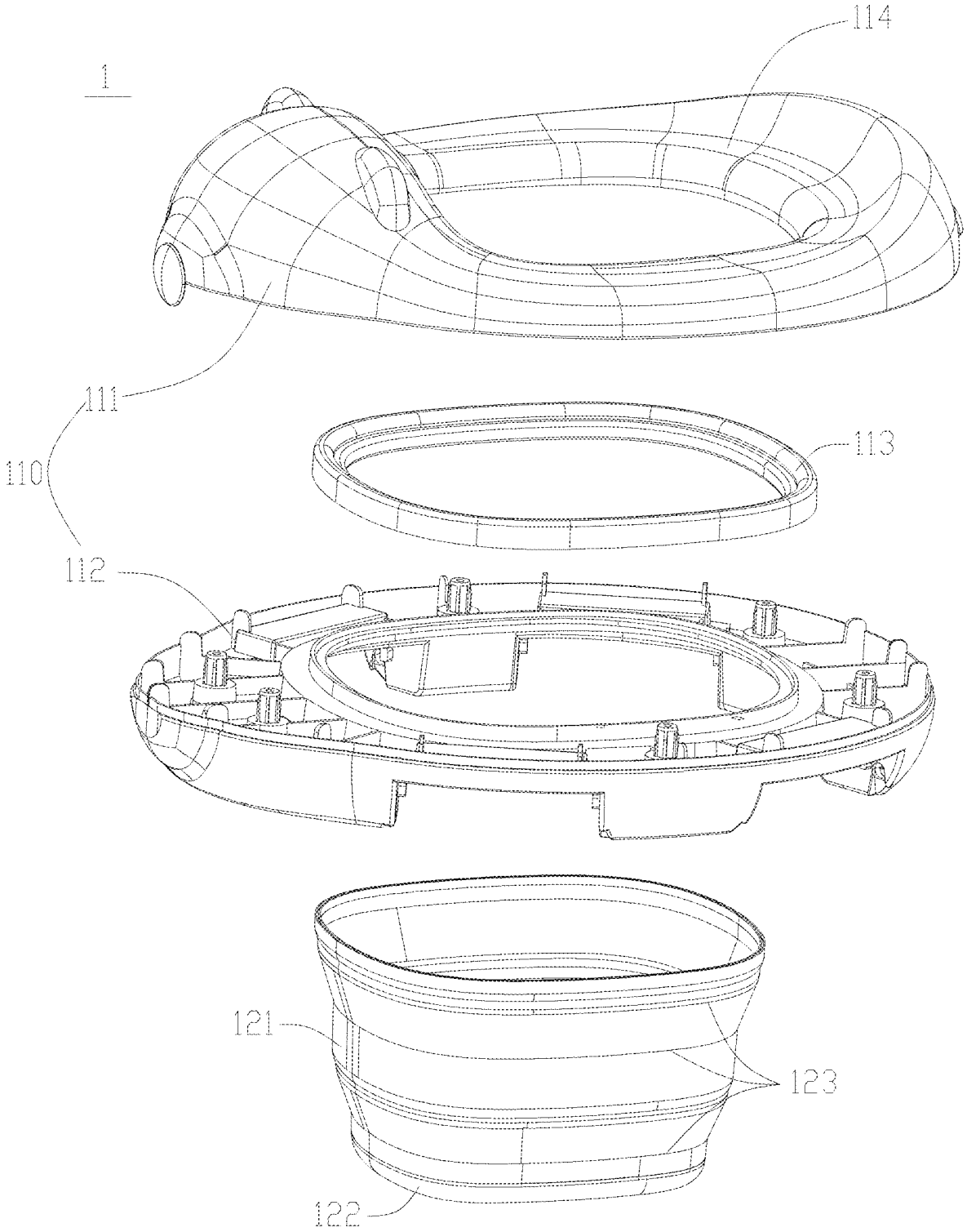
FIG. 9 is an exploded diagram of a toilet main body of the present disclosure.
Figure 10:
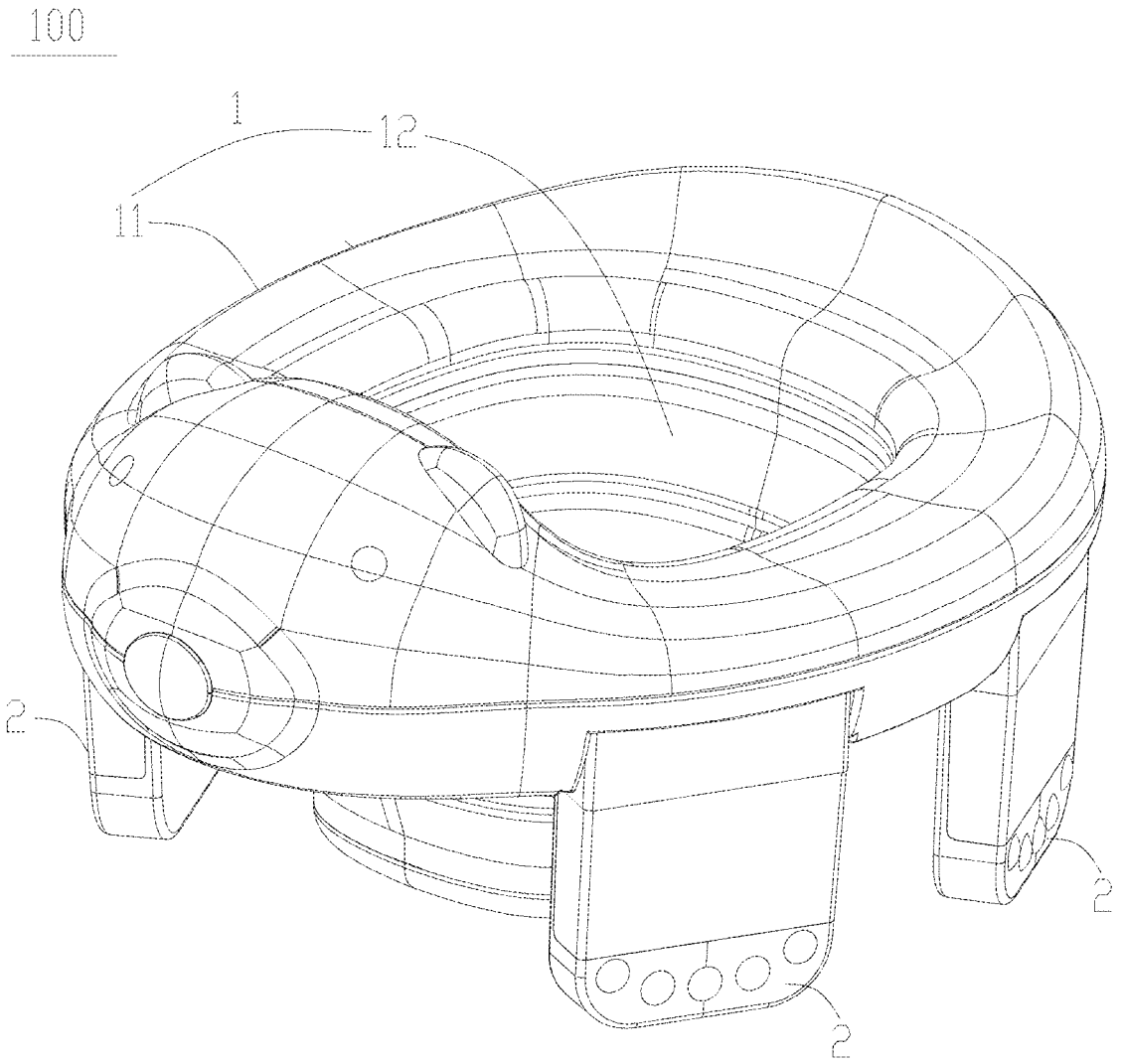
FIG. 10 is a schematic diagram of a supporting portion in a supporting state in a portable toilet of the present disclosure.
Figure 11:
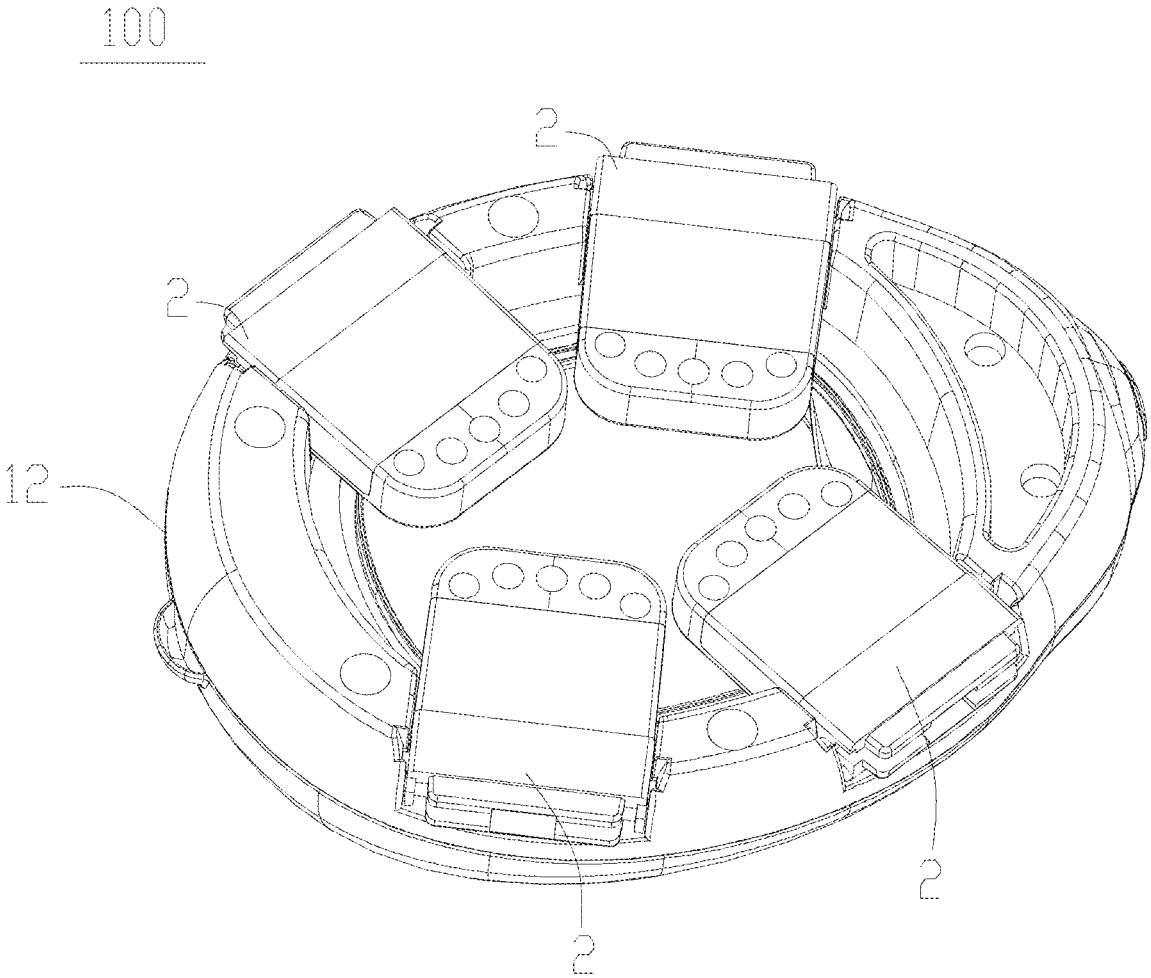
FIG. 11 is a schematic diagram of supporting portions in a folded d state in a portable toilet in the present disclosure.

Referring to FIG. 1 to FIG. 11, a portable toilet 100 in an embodiment of the present disclosure is shown.

The portable toilet 100 includes a toilet main body 1, connecting elements 3, elastic members 4, and a plurality of supporting portions 2. The connecting elements 3 are rotatably arranged on the toilet main body 1: the supporting portions 2 are movably arranged on the connecting elements 3: plug-in assemblies 24*a* are arranged between the supporting portions 2 and the toilet main body 1: the plug-in assemblies 24*a* include positioning slots 28*a* and positioning blocks 29*a*; and the positioning blocks 29*a* are placed in the positioning slots 28*a* when the supporting portions 2 are in a supporting state. When a storage state is switched to a supporting state, the supporting portions 2 rotate relative to the toilet main body 1 and slide relative to the connecting elements 3; and the elastic members 4 are configured to provide the supporting portions 2 with a tendency to move from the outside toward the toilet main body 1.

In this embodiment, by the arrangement of the connecting elements 3 and the elastic members 4 and the movable arrangement of the supporting portions 2 on the connecting elements 3, when the supporting portions 2 rotate, the supporting portions 2 can move relative to the connecting elements 3, and positioning blocks 29*a* can be separated from the positioning slots 28*a*, so that the supporting portions 2 can rotate conveniently. Furthermore, after the supporting portions 2 rotate in place, the supporting portions 2 are released. Under the action of the elastic members 4, the positioning blocks 29*a* can be placed in the positioning slots 28*a* to position the supporting portions 2 and prevent the supporting portions 2 from rotating freely. In this structure, the volumes of the positioning blocks 29*a* can be configured to be larger to enhance the positioning effect on the supporting portions 2 and effectively prolong the service life of the rotating and positioning structures of the supporting portions 2. The problem of poor positioning effect on the supporting portions 2 due to small volumes of buckles used by the supporting portions 2 in the existing portable toilet 100 and the problem of low service life of the supporting portions for rotating and positioning because the supporting portions are easily worn are solved.

In the above embodiment, each connecting elements 3 includes a rotating shaft 31 and a guide rod 32; the rotating shaft 31 is arranged on the toilet main body 1: one end of the guide rod 32 is connected to the rotating shaft 31; and each supporting portion 2 is movably arranged on the guide rod 32. When the rotating shaft 31 rotates, the supporting portion 2 can be driven to rotate together by the guide rod 32. When the supporting portion 2 moves relative to the guide rod 32, the supporting portion 2 can move in the lengthwise direction of the guide rod 32, namely, the supporting portion 2 can move away from or close to the rotating shaft 31. When the supporting portion 2 moves away from the rotating shaft 31, the positioning block 29*a* can be separated from the positioning slot 28*a*. When the supporting portion 2 moves close to the rotating shaft 31, the positioning block 29*a* is placed in the positioning slot 28*a*.

In the above embodiment, a movable slot 25 is provided on the supporting portion 2; a first abutment boss 321 is arranged at one end of the guide rod 32 away from the rotating shaft 31, and a second abutment boss 26 opposite to the first abutment boss 321 is arranged in the movable slot 25; the guide rod 32 is at least partially placed in the movable slot 25, and each elastic member 4 is placed in the movable slot 25; and two ends of the elastic member 4 respectively abut against the first abutment boss 321 and the second abutment boss 26. In this way, when the supporting portion 2 moves away from the rotating shaft 31 under the action of external force, the elastic member 4 is compressed by the relatively close first abutment boss 321 and second abutment boss 26. When the external force disappears, the supporting portion 2 is reset under the action of the elastic member 4, and the supporting portion 2 can be positioned during rotation by cooperation with a plug-in structure. Specifically, the elastic member 4 is a spring, and the spring sleeves the guide rod 32. Of course, in other embodiments, the spring may also be a spring plate.

In an embodiment, the guide rod 32 is provided with a ferrule 322 at one end close to the rotating shaft 31, and the ferrule 322 sleeves the rotating shaft 31, to connect the guide rod 32 with the rotating shaft 31. In other embodiments, the guide rod 32 may also be connected to the rotating shaft 31 through a screw, by welding, or in another way, or the guide rod 32 may be integrally formed with the rotating shaft 31.

In an embodiment, an accommodating slot 27 configured to accommodate the rotating shaft 31 is provided at one end of the supporting portion 2 close to the rotating shaft 31. By the use of the accommodating slot 27, when the supporting portion 2 rotates, the rotating shaft 31 is always in the accommodating slot 27. The accommodating slot 27 is configured to provide a movement space for the supporting portion 2 relative to the guide rod 32, so that the positioning block 29*a* can be used in conjunction with the positioning slot 28*a*.

In an embodiment, each positioning block 29*a* includes an extending portion 24: the extending portion 24 is close to one end of the rotating shaft 31 by the supporting portion 2; and the extending portion 24 is located on one side of the accommodating slot 27. Each positioning slot 28*a* includes a first limiting slot 284: the first limiting slot 284 is arranged on the toilet main body 1; and the extending portion 24 is placed in the first limiting slot 284 when the supporting portion 2 is in the supporting state, to position the supporting portion 2 in the supporting state and make the supporting portion 2 stably support the toilet main body 1. When in the supporting state, that is, the supporting portion 2 is upright. When in the folded state, the supporting portion 2 approaches a bottom surface of the folded toilet main body 1, making it convenient for storage and carrying by a user. In this state, the extending portion 24 is separated from the first limiting slot 284.

In an embodiment, to make the structure of this embodiment compact, the toilet main body 1 is provided with an avoidance slot 1123 communicated to the positioning slot 28*a*, and the supporting portion 2 is at least partially placed in the avoidance slot 1123.

In the above embodiment, the toilet main body 1 is provided with shaft holes 1122 on two side walls of the avoidance slot 1123, and two ends of the rotating rod are respectively placed in the shaft holes 1122 on the two sides of the avoidance slot 1123, to achieve rotatable connection between the connecting elements 3 and the toilet main body 1.

In an embodiment, the two side walls of the avoidance slot 1123 are formed with guide slopes 1121; and the guide slopes 1121 are located below the shaft holes 1122. By the use of the guide slopes 1121, the two ends of the rotating shaft 31 can be mounted into the shaft holes 1122 on the two sides of the avoidance slot 1123. Specifically, the guide slope 1121 can be an inclined surface, a curved surface, or a combination of an inclined surface and a curved surface.

In an embodiment, each positioning block 29*a* includes a limiting convex block 29; and the limiting convex block 29 is arranged on a side wall of the avoidance slot 1123. The positioning slot 28*a* includes a second limiting slot 28 provided on the supporting portion 2; and the limiting convex block 29 is placed in the second limiting slot 28 when the supporting portion is in the folded state or the supporting state, to further position the supporting portion 2 in the supporting state. Furthermore, by the use of the limiting convex block 29, the supporting portion 2 can also be positioned in the folded state, to prevent the supporting portion 2 from being opened when the supporting portion is in the folded state.

Specifically, each second limiting slot 28 includes a supporting state slot 282 and a folded state slot 283 which are provided on the supporting portion 2; the limiting convex block 29 is placed in the supporting state slot 282 when the supporting portion 2 is in the supporting state; and the limiting convex block 29 is placed in the folded state slot 283 when the supporting portion 2 is in the folded state. A side wall of the supporting portion 2 extends along a height of the portable toilet 100 when the supporting portion is in the supporting state; and the side wall of the supporting portion 2 approaches a bottom surface of the portable toilet 100 when the supporting portion is in the folded state, so that during the rotation of the supporting portion 2, when the limiting convex block 29 moves relative to the position of the supporting portion 2, the supporting state slot 282 and the folded state slot 283 can be used to position the supporting portion 2 in different states.

In an embodiment, each second limiting slot 28 further includes an unfolded state slot 281; the limiting convex block 29 is placed in the unfolded state slot 281 when the supporting portion 2 is in an unfolded state; the side wall of the supporting portion 2 extends in a lengthwise or width direction of the portable toilet 100 when the supporting portion is in the unfolded state; and the supporting portion 2 is located on an outer side of the toilet main body 1. The unfolded state slot 281 can be used to position the supporting portion 2 in the unfolded state. In this way, when the toilet main body 1 is in a shape of an animal, the supporting portion 2 is equivalent to a leg of the animal. The supporting portion 2 is in the supporting state, which allows the portable toilet 100 to be in a standing state of the animal. When the supporting portion 2 is in the unfolded state, the portable toilet 100 is in a lie-prone state wherein the legs of the animal stretch out. When the supporting portion 2 is in a folded state, the portable toilet 100 can be in a state where the legs of the animal are received to the bottom of the body.

In the above embodiment, two extending portions 24 are located on two opposite sides of the accommodating slot 27, to enlarge an area of connection between the supporting portion 2 in the supporting state and the toilet main body 1 and make the supporting portion 2 support the toilet main body 1 more stably. The supporting state slot 282 and the folded state slot 283 are respectively located on the two opposite sides of the accommodating slot 27; the folded state slot 283 is communicated to the supporting state slot 282; and the supporting state slot 282, the folded state slot 283, and the unfolded state slot 281 are all communicated to the accommodating slot 27, so that when the limiting convex block 29 moves relative to the position of the supporting portion 2, the limiting convex block 29 can position the supporting portion 2 in different states.

In an embodiment, an antiskid sleeve 23 is arranged at a bottom of each supporting portion 2, so that the portable toilet 100 will not slide during use. Specifically, a material of the antiskid sleeve 23 is a soft rubber material or an antiskid material.

In an embodiment, to make the structure of the supporting portion 2 more compact, each supporting portion 2 includes a first supporting member 21 and a second supporting member 22 connected to the first supporting member 21; and the movable slot 25 and the second abutment boss 26 are both located on the first supporting member 21.

In an embodiment, the second supporting member 22 has a chamber 220 with an opening in one side; and a stiffener 222 and a stud 223 are arranged in the chamber 220. the first supporting member 21 is at least partially located in the chamber 220; and the first supporting member 21 is locked on the stud 223 through a screw. By the use of the stiffener, the strength of the supporting portion can be enhanced, and the supporting force can be increased.

In an embodiment, the toilet main body 1 includes a supporting ring 11 and a foldable potty 12; the supporting ring 11 is arranged at a top of the potty 12; the connecting elements 3 are rotatably connected to the supporting ring 11; and a material of at least a portion of the supporting ring 11 is a hard material, to cooperate with the supporting portion 2 for use.

In an embodiment, the potty 12 includes an annular wall 121 and a potty bottom 122; the potty bottom 122 is arranged at a bottom of the annular wall 121; the supporting ring 11 is arranged at a top of the annular wall 121; a material of the annular wall 121 is a flexible material. A width and length of the annular wall 121 gradually decrease from top to bottom; and at least one crease is arranged on the annular wall 121, to achieve folding of the annular wall 121. Furthermore, during folding, the volume of the product in this embodiment can be effectively reduced for ease of storage and carrying. A material of the potty bottom 122 can be either hard or flexible.

In an embodiment, the supporting ring 11 includes a connecting ring 113 and a decorative shell 110; the decorative shell 110 is arranged on the connecting ring 113; the connecting ring 113 is connected to the annular wall 121; and the decorative shell 110 can have an animal shape or other shapes to decorate the portable toilet 100 of this embodiment and enhance the strength of the support ring 11.

In an embodiment, a top of the decorative shell 110 is recessed downwards to form a toilet groove 114, so that during use, the hip of a user is misaligned with the potty 12.

In an embodiment, the decorative shell 110 includes a top shell 111 and a bottom shell 112; the connecting ring 113 is located between the top shell 111 and the bottom shell 112; the top shell 111 is connected to the bottom shell 112 and compresses the connecting ring 113; and the toilet groove 114 is located on the top shell 111. The shaft holes 1122, the first limiting slots 284, and the avoidance slots 1123 are all located on the bottom shell 112, to achieve the connection between the decorative shell 110 and the connecting ring 113.

In an embodiment, there may be four supporting portions 2, to effectively support the toilet main body 1. Of course, in other embodiments, there may be two, three, five, six, or more supporting portions 2. The number of the supporting portions 2 will not be limited here.

It should be noted that all directional indications (such as up, down, left, right, front, back . . . ) in the embodiments of the present disclosure are only used to explain a relative positional relationship between components, motion situations, etc. at a certain specific attitude (as shown in the figures). If the specific attitude changes, the directional indication also correspondingly changes.

In addition, the descriptions of "first", "second", etc. in the present disclosure are only used for descriptive purposes, and cannot be understood as indicating or implying its relative importance or implicitly indicating the number of technical features indicated. Therefore, features defined by "first" and "second" can explicitly instruct or impliedly include at least one feature. In addition, "and/or" in the entire text includes three solutions. A and/or B is taken as an example, including technical solution A, technical solution B, and technical solutions that both A and B satisfy. In addition, the technical solutions between the various embodiments can be combined with each other, but it needs be based on what can be achieved by those of ordinary skill in the art. When the combination of the technical solutions is contradictory or cannot be achieved, it should be considered that such a combination of the technical solutions does not exist, and is not within the scope of protection claimed by the present disclosure.

The above descriptions are only preferred embodiments of the present disclosure, and are not intended to limit the patent scope of the present disclosure. Any equivalent structural transformation made by using the content of the specification and the drawings of the present disclosure under the invention idea of the present disclosure, directly or indirectly applied to other related technical fields, shall all be included in the scope of patent protection of the present disclosure.

What is claimed is:

1. A portable toilet (100), comprising:

a toilet main body (1);

connecting elements (3) rotatably arranged on the toilet main body;

a plurality of supporting portions (2) movably arranged on the connecting elements (3);

plug-in assemblies (24*a*) arranged between the supporting portions (2) and the toilet main body (1), wherein the plug-in assemblies (24*a*) comprise positioning slots (28*a*) and positioning blocks (29*a*): the positioning blocks (29*a*) are placed in the positioning slots (28*a*) when the supporting portions (2) are in a supporting state; and elastic members (4), wherein when a storage state is switched to a supporting state, the supporting portions (2) rotate relative to the toilet main body (1) and slide relative to the connecting elements (3); and the elastic members (4) are configured to provide the supporting portions (2) with a tendency to move from the outside toward the toilet main body (1).

2. The portable toilet (100) according to claim 1, wherein each connecting elements (3) comprises a rotating shaft (31) and a guide rod (32); the rotating shaft (31) is arranged on the toilet main body (1): one end of the guide rod (32) is connected to the rotating shaft (31); and each supporting portion (2) is movably arranged on the guide rod (32).

3. The portable toilet (100) according to claim 2, wherein a movable slot (25) is provided on the supporting portion (2): a first abutment boss (321) is arranged at one end of the guide rod (32) away from the rotating shaft (31), and a second abutment boss (26) opposite to the first abutment boss (321) is arranged in the movable slot (25); the guide rod (32) is at least partially placed in the movable slot (25), and each elastic member (4) is placed in the movable slot (25); and two ends of the elastic member (4) respectively abut against the first abutment boss (321) and the second abutment boss (26).

4. The portable toilet (100) according to claim 3, wherein the guide rod (32) is provided with a ferrule (322) at one end close to the rotating shaft (31), and the ferrule (322) sleeves the rotating shaft (31).

5. The portable toilet (100) according to claim 2, wherein an accommodating slot (27) configured to accommodate the rotating shaft (31) is provided at one end of the supporting portion (2) close to the rotating shaft (31).

6. The portable toilet (100) according to claim 5, wherein each positioning block (29*a*) comprises an extending portion (24): the extending portion (24) is close to one end of the rotating shaft (31) by the supporting portion (2): the extending portion (2) is located on one side of the accommodating slot (27):

each positioning slot (28*a*) comprises a first limiting slot (284); the first limiting slot (284) is arranged on the toilet main body (1); and the extending portion (24) is placed in the first limiting slot (284) when the supporting portion (2) is in the supporting state.

7. The portable toilet (100) according to claim 6, wherein the toilet main body (100) is provided with an avoidance slot (1123) communicated to the positioning slot (28*a*), and the supporting portion (2) is at least partially placed in the avoidance slot (1123).

8. The portable toilet (100) according to claim 7, wherein the toilet main body (1) is provided with shaft holes (1122) on two side walls of the avoidance slot (1123), and two ends of the rotating shaft are respectively placed in the shaft holes (1122) on the two sides of the avoidance slot (1123).

9. The portable toilet (100) according to claim 8, wherein the two side walls of the avoidance slot (1123) are formed with guide slopes (1121); and the guide slopes (1123) are located below the shaft holes (1122).

10. The portable toilet (100) according to claim 7, wherein each positioning block (29*a*) comprises a limiting convex block (29): the limiting convex block (29) is arranged on a side wall of the avoidance slot (1123);

the positioning slot (28*a*) comprises a second limiting slot (28) provided on the supporting portion (2); and the limiting convex block (29) is placed in the second limiting slot (28) when the supporting portion (2) is in the folded state or the supporting state.

11. The portable toilet (100) according to claim 9, wherein each second limiting slot (28) comprises a supporting state slot (282) and a folded state slot (283) which are provided on the supporting portion (2): the limiting convex block (29) is placed in the supporting state slot (282) when the supporting portion (2) is in the supporting state, and the limiting convex block (29) is placed in the folded state slot (283) when the supporting portion (2) is in the folded state; a side wall of the supporting portion (2) extends along a height of the portable toilet (100) when the supporting portion (2) is in the supporting state; and the side wall of the supporting portion (2) approaches a bottom surface of the portable toilet (100) when the supporting portion (2) is in the folded state.

12. The portable toilet (100) according to claim 11, wherein each second limiting slot (28) further comprises an unfolded state slot (281); the limiting convex block (29) is placed in the unfolded state slot (281) when the supporting portion is in an unfolded state: the side wall of the supporting portion (2) extends in a lengthwise or width direction of the portable toilet (100) when the supporting portion (2) is in the unfolded state; and the supporting portion (2) is located on an outer side of the toilet main body (1).

13. The portable toilet (100) according to claim 12, wherein two extending portions (24) are located on two opposite sides of the accommodating slot (27): the supporting state slot (282) and the folded state slot (283) are respectively located on the two opposite sides of the accommodating slot (27); the folded state slot (283) is communicated to the supporting state slot (282); and the supporting state slot (282), the folded state slot (283), and the unfolded state slot (281) are all communicated to the accommodating slot (27).

14. The portable toilet (100) according to claim 1, wherein an antiskid sleeve (23) is arranged at a bottom of each supporting portion (2).

15. The portable toilet (100) according to claim 3, wherein each supporting portion (2) comprises a first supporting member (21) and a second supporting member (22) connected to the first supporting member (21); and the movable slot (25) and the second abutment boss (26) are both located on the first supporting member (21).

16. The portable toilet (100) according to claim 15, wherein the second supporting member (22) has a chamber (220) with an opening in one side: a stiffener (222) and a stud (223) are arranged in the chamber (220);

the first supporting member (21) is at least partially located in the chamber (220); and the first supporting member (21) is locked on the stud (223) through a screw.

17. The portable toilet (100) according to claim 1, wherein the toilet main body (1) comprises a supporting ring (11) and a foldable potty (12); the supporting ring (11) is arranged at a top of the potty (12); the connecting elements (3) are rotatably connected to the supporting ring (11); and a material of at least a portion of the supporting ring (11) is a hard material.

18. The portable toilet (100) according to claim 17, wherein the potty (12) comprises an annular wall (121) and a potty bottom (122); the potty bottom (122) is arranged at a bottom of the annular wall (121); the supporting ring (11) is arranged at a top of the annular wall (121); a material of the annular wall (121) is a flexible material;

a width and length of the annular wall (121) gradually decrease from top to bottom; and at least one crease is arranged on the annular wall (121).

19. The portable toilet (100) according to claim 18, wherein the supporting ring (11) comprises a connecting ring (113) and a decorative shell (110); the connecting ring (113) is connected to the annular wall (121); and the decorative shell (110) is arranged on the connecting ring (113).

20. The portable toilet (100) according to claim 19, wherein a top of the decorative shell (110) is recessed downwards to form a toilet groove (114);

the decorative shell (110) comprises a top shell (111) and a bottom shell (112); the connecting ring (113) is located between the top shell (111) and the bottom shell (112); the top shell (111) is connected to the bottom shell (112) and compresses the connecting ring (113); and the toilet groove (114) is located on the top shell (111).

* * * * *